US005188427A

United States Patent [19]

LeBegue et al.

[11] Patent Number: 5,188,427

[45] Date of Patent: Feb. 23, 1993

[54] TWIN SCRUBBER AND AIR DIFFUSER FOR A CONTINUOUS MINER AND METHOD OF VENTILATION

[75] Inventors: Maurice K. LeBegue, Fairmont, W. Va.; Julius N. Hornyak, Oakland, Md.

[73] Assignee: Tamrock World Corporation N. V., Curacao, Netherlands

[21] Appl. No.: 714,680

[22] Filed: Jun. 13, 1991

[51] Int. Cl.[5] ..... E21C 35/22; E21F 5/20

[52] U.S. Cl. ..... 299/12; 299/64; 454/171

[58] Field of Search ..... 299/12, 18, 64, 68; 55/257.2; 454/168, 171, 172

[56] References Cited

U.S. PATENT DOCUMENTS

| | | | |
|---|---|---|---|
| 3,225,678 | 12/1965 | Densmore | 454/171 |
| 3,712,678 | 1/1973 | Amoroso | 299/68 |
| 3,792,568 | 2/1974 | Gundlach et al. | 55/223 |
| 3,810,677 | 5/1974 | David | 299/64 |
| 3,824,911 | 7/1974 | Janelid et al. | 299/12 X |
| 3,919,930 | 11/1975 | Yoshikawa et al. | 454/171 |
| 4,076,315 | 2/1978 | Gunlach et al. | 299/64 |
| 4,157,204 | 6/1979 | Kissell et al. | 299/64 |
| 4,249,778 | 2/1981 | McGuire | 299/64 |
| 4,380,353 | 4/1983 | Campbell et al. | 299/12 |
| 4,463,973 | 8/1984 | Westphal | 285/298 |
| 4,531,784 | 7/1985 | Karlovsky | 299/64 |
| 4,557,524 | 12/1985 | Melhuish | 299/64 |
| 4,840,432 | 6/1989 | LeBegue et al. | 299/64 |
| 4,936,632 | 6/1990 | LeBegue et al. | 299/64 |

FOREIGN PATENT DOCUMENTS

| | | | |
|---|---|---|---|
| 2202296 | 7/1973 | Fed. Rep. of Germany | 299/12 |
| 2635405 | 2/1978 | Fed. Rep. of Germany | 299/12 |
| 2738503 | 3/1979 | Fed. Rep. of Germany | 299/12 |
| 704673 | 2/1954 | United Kingdom . | |

OTHER PUBLICATIONS

Mining Congress Journal "Face Ventilation and Dust Control with Continuous Mining Machines", pp. 34–38, Aug. 1959.

*Primary Examiner*—David J. Bagnell
*Attorney, Agent, or Firm*—Stanley J. Price, Jr.

[57] ABSTRACT

A continuous mining machine is provided with dual ductwork having reversible fans. The ductwork extends longitudinally along each side of the continuous mining machine. Each fan is positioned in a duct at the rear end of the frame of the mining machine. A crossover duct connects in fluid communication with longitudinally extending ducts. The crossover duct includes pivotal gates positioned adjacent to the connection of the crossover duct to the longitudinal ducts. Each of the longitudinal ducts includes a pivotal gate positioned between the connection of the crossover duct to the duct and the fan positioned in the duct. By selecting which gates are opened and closed the flow of air through the ducts can be directed to either side of the mining machine. By selective reversal of the fans dust entrained air is withdrawn from the mine face and directed in a desired path through the ductwork in one mode of operation and ventilating air is directed to the mine face in a desired path through the ductwork in a second mode of operation.

20 Claims, 2 Drawing Sheets

TWIN SCRUBBER AND AIR DIFFUSER FOR A CONTINUOUS MINER AND METHOD OF VENTILATION

BACKGROUND OF THE INVENTION

1. Field of the Invention

This invention relates to a mining machine, and more particularly, to a mining machine having a dust collecting system that includes a pair of ducts each extending longitudinally on each side of the frame of the mining machine and are connected by a crossover duct assembly with a plurality of pivotal gates positioned in the longitudinal and crossover ducts to control the flow of air through the duct system to and from the mine face.

2. Description of the Prior Art

In underground mining, it is well known to provide a continuous mining machine which includes a material dislodging mechanism positioned on the front end of the mining machine for dislodging material from a mine face. The dislodged material is conveyed rearwardly of the mining machine by a conveying system positioned on the mining machine. The mining machine continuously advances and dislodges the material being mined to form an entry in the material seam.

Duct assemblies on mining machines are known, such as disclosed in U.S. Pat. No. 3,712,678 directed to a dust collecting system carried on a boom of the mining machine.

Contrarotary centrifugal fans collect dust entrained air which is conveyed through ductwork extending on either a side of the body of the mining machine. A scrubber may also be associated with the ductwork.

U.S. Pat. No. 3,792,568 discloses a scrubber for use on a continuous mining machine utilizing a rotor, a wetting agent and baffles. The cleaned air is directed back toward the mine face and the wetted particulates are discharged onto the conveyor of the mining machine.

U.S. Pat. No. 3,810,677 discloses a scrubber device for use on an underground mining machine utilizing air intakes adjacent to the mining machine cutting heads, a wetting agent, and a centrifugal fan mounted between rotor plates that project air and dust particles against a spiral outer wall of the rotor housing. This scrubber device is located on the boom of the mining machine. The resultant slurry is discharged onto the conveying means of the mining machine.

U.S. Pat. No. 4,076,315 discloses a dust abatement device for a mining machine utilizing a water spray and a centrifugal fan that draws dust entrained air into its center and impinges the air with the particulates against the wetted fan blades and baffles to suspend the particles in solution. The cleaned air and slurry are then directed to the mine face to wet the dust produced by the mining machine head.

U.S. Pat. No. 4,157,204 discloses a mine ventilation system for use with a mining machine in which a line curtain conducts dust entrained air away from the mining area. A panel mounted on the mining machine acts as an extension of the line curtain. Water nozzles mounted on the panel direct a flow of dust entrained air into the line curtain. Water spray nozzles are mounted on the side of the mining machine, oppositely of the line curtain. The machine mounted nozzles form a water barrier in the gap between the line curtain and the machine mounted panel.

U.S. Pat. No. 4,249,778 discloses method and apparatus for removing moisture from air after it has passed through a scrubber on a mining machine. A demister includes a sump that projects above the bottom wall of the demister at the outlet portion. The airflow through the demister moves upwardly creating a "dead" air space above the accumulated water level in the sump, thus preventing reentrainment of moisture.

U.S. Pat. No. 4,380,353 discloses a dust control device and a method of operation for use on a mining machine. The dust control device includes a vane axial fan comprising a housing having an inlet and an outlet with a motor mounted in the housing for rotating vanes of the fan. Upstream from the fan is a flooded bed scrubber having a plurality of layers of netted wire cloth of stainless steel wire having a preselected density for entrainment in droplets of water of dust. A demister is located between the fan and the scrubber, and a jet sump associated with the demister directs the water gathered to the top of the cutter head of the mining machine. A telescoping duct transition section is also disclosed.

U.S. Pat. No. 4,463,973 discloses a sealed hinge for use in an air duct system for connecting a suction source of the air duct with a inlet on a mining machine. The connection disclosed is a movable hinged section.

U.S. Pat. No. 4,531,784 discloses a dust collecting apparatus for use with a continuous mining machine that utilizes a high pressure fluid sprayed from manifolds to induce a flow of air through ductwork located between the boom arms of the mining machine and laterally of the boom arms on the mining machine. The dust collecting unit and the lateral units utilize a demister to separate the slurry produced from the cleaned air. The slurry is directed onto the conveyor of the continuous mining machine and the cleaned air is expelled adjacent the boom of the continuous mining machine.

U.S. Pat. No. 4,557,524 discloses on a mining machine a transitional ductwork for connecting the ductwork on a boom portion pivotally with the fixed ductwork on the frame of the mining machine. The transitional section consists of the end of the boom ductwork fitting into the fixed ductwork on the frame. The boom ductwork has top and bottom hinged plates to engage the inside of the top and bottom fixed ductwork walls. A sleeve-like outer piece fits over the junction of the boom and fixed ductworks to seal the sides of the ductwork.

U.S. Pat. No. 4,840,432 discloses a continuous mining machine having a hollow boom assembly pivotally attached to the frame of the mining machine. The hollow boom assembly has an inlet for receiving dust entrained air and is connected to ductwork in the mining machine frame. The ductwork on the mining machine frame includes a fan as a collecting means. The hollow boom assembly connects to the ductwork on the frame by forming arcuate ends which fit into and slidingly engage arcuate ends formed by the connecting portion of the ductwork on the mining machine frame.

U.S. Pat. No. 4,936,632 discloses a continuous mining machine having a hollow boom assembly acting as a duct for collecting dust entrained air pivotally attached to a mobile frame and ductwork connected to the hollow boom. The dust entrained air is collected in the hollow boom which is in fluid commmunication with the ductwork. The ductwork includes a first duct assembly extending longitudinally along one side of the continuous mining machine and connected to a fan assembly at the rear end of the continuous mining machine. The second duct assembly extends from the hollow boom to the side of the continuous mining machine opposite the first duct assembly and is located on and extends partially along that side of the continuous mining machine. The second duct assembly traverses the continuous mining machine between the conveyor reach and return reach.

While it is known to include various types of ductwork assemblies on continuous mining machines, the known devices do not disclose a dual duct assembly with each duct assembly having a reversible fan assembly. There is a need for an improved mining machine having a dual duct system with each duct system having a reversible fan assembly which allows the fan to act as a dust collector or as a mechanism for blowing air toward the mine face.

There is also a need for an improved mining machine having a dual duct system with the capacity to use either of two reversible fan assemblies to draw dust entrained air away from the mine face.

SUMMARY OF THE INVENTION

In accordance with the present invention there is provided a mining machine that includes a mobile frame having a front end portion and rear end portion. A boom member is pivotally secured to the mobile frame front end portion and extends forwardly therefrom. Dislodging means connected to the front end of the boom member dislodges mine material from the mine face. Conveying means extends rearwardly on the mobile frame for transporting mined material dislodged from the mine face from the dislodging means to the frame rear end portion. Collecting means positioned on the mobile frame removes pollutants entrained in the air surrounding the dislodging means. The collecting means includes a first duct system and a second duct system extending longitudinally on the mobile frame on opposite sides of the conveyor means, respectively. The first and second duct systems each include an inlet positioned rearwardly of the dislodging means and an outlet positioned adjacent to the frame rear end portion with a continuous passageway extending between the inlet and the outlet for flow of air therethrough. A fan is positioned in the passageway of each of the first and second duct systems adjacent to the outlet. Each of the fans is reversible to direct pollutant entrained air in a first direction from the inlet to the outlet and to direct air in a second direction substantially free of pollutants from the outlet to the inlet. Each of the fans is selectively operated to direct pollutant entrained air in a selected one of the duct systems in the first direction while directing air substantially free of pollutants in the other of the duct systems in the second direction.

Further in accordance with the present invention there is provided a ventilation system for a mining machine that includes a pair of air passage ducts extending longitudinally in substantially spaced apart relation on a mining machine. The ducts each have an inlet for receiving pollutant laden air into the respective duct and an outlet for discharging air from the duct. Air flow control means is positioned in each of the ducts adjacent to the outlet for drawing flow of air in a first mode from the inlet to the outlet and in a second mode from the outlet to the inlet. Adjustment means actuates the air flow control means to direct flow of air through the ducts in a selected one of the first and second modes to simultaneously direct air from the outlet to the inlet in one of the ducts while directing air from the inlet to the outlet in the other of the ducts.

Additionally, the present invention is directed to a method for ventilating the face of an underground mine comprising the steps of positioning a mining machine adjacent to a mine face. Ductwork is supported on the mining machine to extend longitudinally on opposite sides of the mining machine. Air is conveyed through a pair of passageways of the ductwork between an inlet at one end of each passageway adjacent to the mine face and an outlet at an opposite end of each passageway removed from the mine face. The flow of air is directed through the pair of passageways in a preselected direction between the inlet and the outlet. Pollutant laden air is conveyed away from the mine face through one of the passageways from the inlet to the outlet thereof while simultaneously conveying air substantially free of pollutants through the other of the passageways from the outlet to the inlet toward the mine face.

Accordingly, the principal object of the the present invention is to provide method and apparatus for ventilating a mine face by positioning on a mining machine operating at the mine face ductwork for directing pollutant laden air from the mine face and supplying fresh air to the mine face.

Another object of the present invention is to provide dust collecting apparatus on a mining machine that simultaneously removes pollutant laden air from the mine face and supplies fresh air to ventilate the mine face and dilute any methane gas generated at the mine face.

A further object of the present invention is to provide on a mining machine a duct system that includes air passageways extending longitudinally on opposite sides of the machine and including reversible fans for selectively withdrawing pollutant laden air from the mine face and/or supplying fresh air to ventilate the mine face.

An additional object of the present invention is to provide a ventilation system for a mining machine having a pair of spaced apart ducts extending longitudinally on the machine frame connected by a crossover duct where each duct includes a reversible fan and scrubber means for facilitating selective paths for removal of dust laden air through the ductwork from the mine face and the supply of fresh air through the ductwork to the mine face.

These and other objects of the present invention will be more completely disclosed and described in the following specification, accompanying drawings, and the appended claims.

DESCRIPTION OF THE PREFERRED EMBODIMENTS

Figure 1:
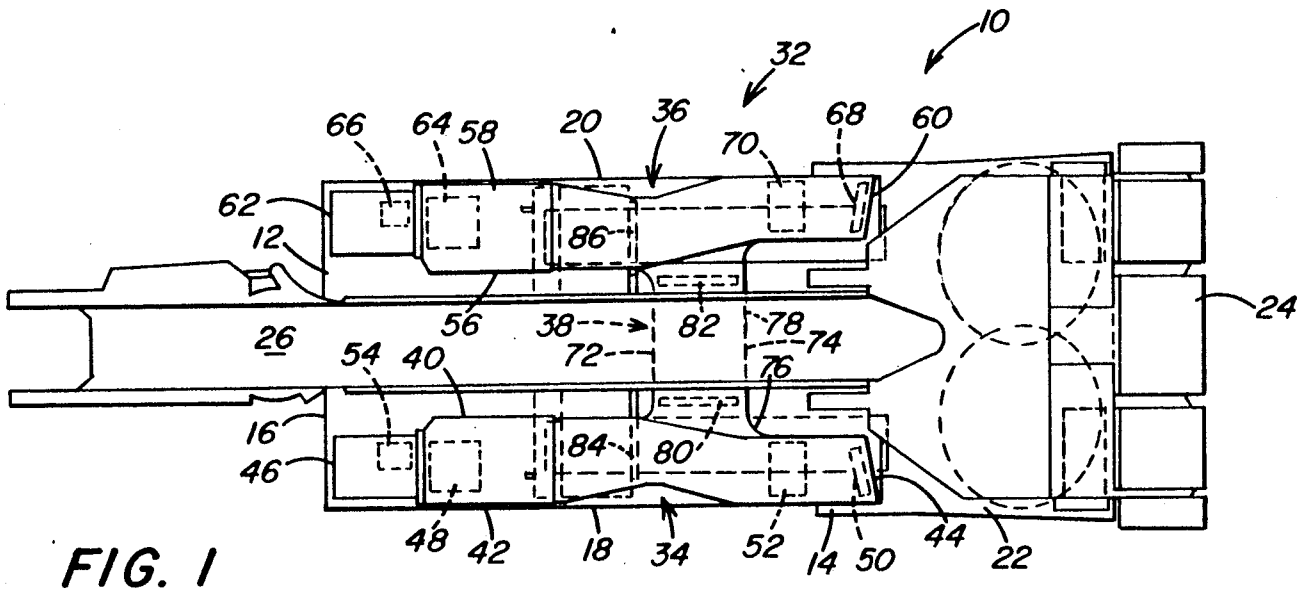
FIG. 1 is a top plan view of a continuous mining machine illustrating a duct collecting system mounted thereon.
Figure 2:
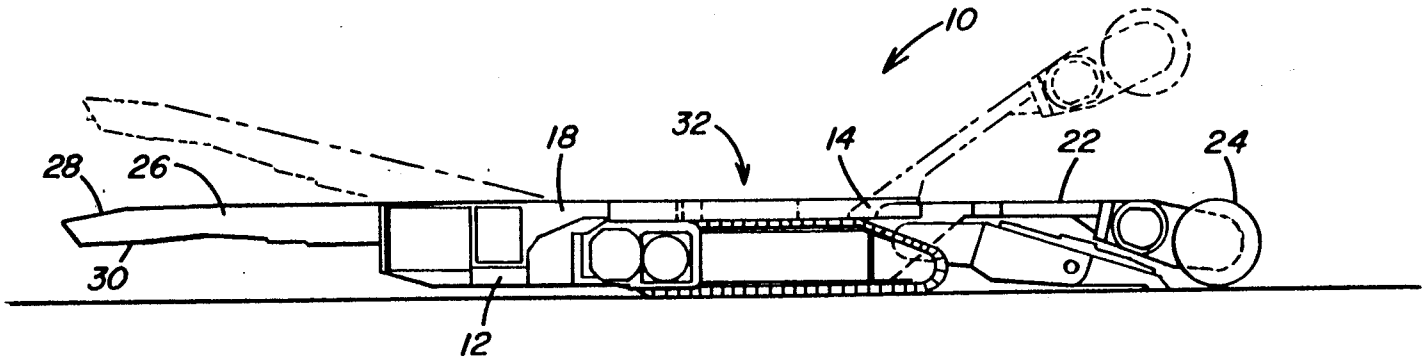
FIG. 2 is a view in side elevation of a continuous mining machine, illustrating in phantom the elevation of the boom arm and the elevation of the rear conveying means.

Referring to the drawings, and particularly to FIGS. 1 and 2, there is illustrated a continuous mining machine generally designated by the numeral 10 for use in underground mines to dislodge material from the mine face. Continuous mining machine 10 includes a mobile frame assembly 12 with a front end portion 14, rear end portion 16, first side portion 18 and second side portion 20. Continuous mining machine 10 also includes a boom assembly 22. Boom assembly 22 is attached on one end to the front end portion 14 of the mobile frame assembly 12. The boom assembly 22 has a cutter drum 24 connected thereto. Continuous mining machine 10 includes a longitudinally extending conveyor 26 having an upper conveyor reach 28 and a lower return reach 30 as illustrated in FIG. 2.

In accordance with the present invention the mining machine 10 includes a dust collecting system generally designated by the numeral 32 to remove dust entrained air from the vicinity of the mine face due to the action of the cutter drum 24. The collecting system 32 includes a first duct assembly 34, a second duct assembly 36, and a crossover duct portion 38. The first and second duct assemblies 34 and 36 extend longitudinally on the frame 12 and are connected to one another by the crossover duct portion 38 which extends transversely on the frame 12.

The first duct assembly 34 includes lateral side walls 40 and 42. Lateral side walls 40 and 42 are generally parallel to each other and extend the length of the first side 18 of the continuous mining machine 10. The side walls 40 and 42 are spaced by and connected to a top wall (not shown) and a bottom wall (not shown). The first duct assembly 34 further includes opposed open end portions 44 and 46 forming a longitudinal passageway for the flow of air therethrough. End portion 44 in positioned rearwardly of the cutter drum 24, and end portion 46 is positioned adjacent to frame rear end portion 16. A reversible fan assembly 48 is positioned in the duct assembly 34 adjacent open end portion 46.

The fan assembly 48 is a conventional reversible fan which is operable in a first mode to draw pollutant laden air into opening 44 as an inlet to the air passageway and direct the pollutant laden air generated during the dislodging operation to a combination spray-type scrubber 50 and demister 52. A suitable spray-type scrubber and demister for use in the present invention is disclosed in U.S. Pat. No. 4,380,353 entitled, "Dust Control System And Method Of Operation" which is incorporated herein by reference. The treated air is drawn through the duct assembly 34 and discharged through opening 46 as an outlet of the air passageway.

In a second mode of operation of the fan assembly 48, the direction of rotation of the fan is reversed to draw fresh air through opening 46 as an inlet to the air passageway of duct assembly 34. The air is diffused toward the front of the mining machine 10 to the opening 44. The air under pressure is expelled from opening 44 as an outlet for supplying fresh air to ventilate the mine face. If methane gas is generated at the mine face, then the fresh air supplied through the duct assembly 34 serves to dilute the concentration of methane gas in the working environment. Accordingly, the direction of air flow through the duct assembly 34 is controlled by the direction of operation of the fan assembly 48. The direction of operation of fan assembly 48 is selected by operation of a motor controller 54 associated with the fan assembly 48.

The second duct assembly 36 extends along the second side 20 of the mobile frame 12 of the continuous mining machine 10 substantially parallel to the first duct assembly 34. The second duct assembly 36 includes a side wall 56 generally parallel to and lateral to an opposite side wall 58. The pair of side walls 56 and 58 are spaced by and connected to a horizontal top wall (not shown) and a horizontal bottom wall (not shown). The second duct assembly 36 includes opposed open end portions 60 and 62 forming a longitudinal passageway for the flow of air therethrough. End portion 60 is positioned rearwardly of the cutter drum 24, and end portion 62 is positioned adjacent to frame rear end portion 16.

A reversible fan assembly 64, corresponding to fan assembly 48, is positioned in the duct assembly 36 adjacent open end portion 62. The fan assembly 64 is also operable by a motor controller 66 in a first mode to draw pollutant laden air into opening 60 as an inlet to the air passageway and in a second mode to draw fresh air through duct opening 62 for supplying the mine face with ventilating air. The duct assembly 36 also includes a combination spray scrubber 68 and demister 70, as above described.

First duct assembly 34 and second duct assembly 36 are connected in fluid communication with each other by a the crossover duct assembly 38. Crossover duct assembly 38 traverses mining machine 10 between the conveyor reach 28 and the conveyor return reach 30. Crossover duct assembly 38 is formed by opposed side walls 72 and 74 which are spaced by and connected to a horizontal top wall (not shown) and a horizontal bottom wall (not shown). The crossover duct 38 has a first end 76 which is connected to the first duct assembly 34 between the reversible fan assembly 48 and the opening 44 in the first duct assembly 34. The crossover duct 38 also has a second end 78 which is connected to the second duct assembly 36 between the second reversible fan assembly 64 and the opening 60 in the second duct assembly 36.

As shown in FIG. 1 a first pivotally hinged gate 80 is located in the crossover duct 38 at the first end 76 of the crossover duct 38 adjacent to the first duct assembly 34. First gate 80 provides a barrier to the fluid communication between the first duct assembly 34 and the crossover duct 38. A suitable control device (not shown) is operable to pivot gate 80 between a closed position shown in FIG. 1 and an open position connecting duct assembly 34 with crossover duct 38.

Crossover duct 38 includes a second gate 82 located at the second end 78 adjacent to the second duct assembly 36. The second gate 82 provides a barrier to the fluid communication between the second duct assembly 36 and crossover duct 38 when the gate 82 is closed. A suitable control device is also provided to pivot gate 82 between a closed position as shown in FIG. 1 and an open position connecting duct assembly 36 with crossover duct 38.

Figure 3:
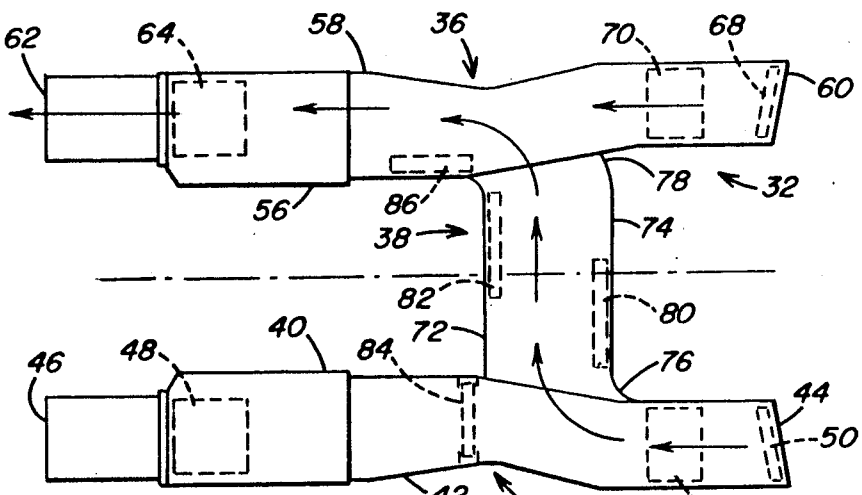
FIG. 3 is a schematic diagram of the dust collecting system of the present invention, illustrating a duct assembly having a pair of longitudinally extending duct connected by a crossover duct with a pivotal gate positioned in one duct for directing pollutant laden air from the duct inlets to an outlet of one of the ducts.

Each of the duct assemblies 34 and 36 also includes a pivotal gate for controlling the flow of air therethrough. A pivotally hinged gate 84 is located in the first duct assembly 34 between the reversible fan assembly 48 and the entrance 76 to the crossover duct 38. The gate 84 when closed provides a barrier to the fluid communication between the reversible fan assembly 48 and the remaining duct assemblies 34, 36 and 38. Thus, when the gate 84 in the first duct assembly 34 is in the closed position and crossover duct gates 80 and 82 are in the open position, operation of fan assembly 64 in an exhaust mode draws dust entrained air into duct inlets 44 and 60 and through the scrubber and demister units 68 and 70. The air in duct assembly 36 is then directed to the duct outlet 62. With the gate 84 closed as shown in FIG. 3, the dust entrained air drawn into duct inlet 44 of duct assembly 34 is directed through crossover duct 38 into duct assembly 36 to outlet 62. This permits the treated air to be exhausted from only one side of the mining machine.

Figure 4:
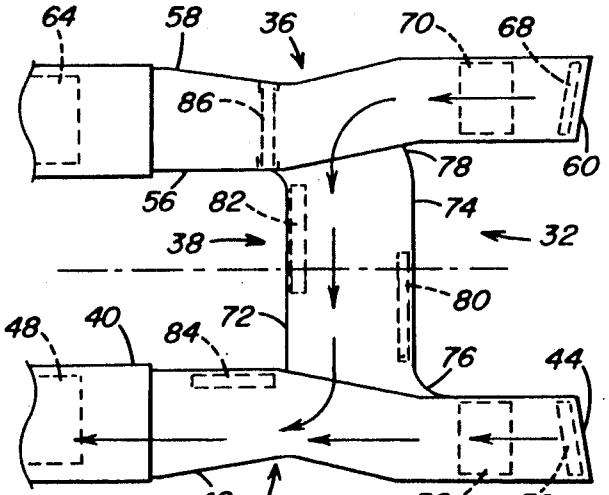
FIG. 4 is a schematic diagram similar to FIG. 3 of the dust collecting system, illustrating the flow of pollutant laden air through one longitudinal duct while fresh air is supplied in the opposite direction through the other duct with the crossover duct closed from both ducts.

An additional pivotally hinged gate 86 in the second duct assembly 36 is located between the reversible fan assembly 64 and the second end 78 of the crossover duct 38. The gate 86 in the second duct assembly 36 provides a barrier to the fluid communication between the reversible fan assembly 64 and the opposite end 60 of the second duct assembly 36, the first duct assembly 34 and the crossover duct 38. Thus, when the gate 86 is in the closed position, as shown in FIG. 4, gates 80, 82 and 84 are in the open position. The reversible fan assembly 48 is in fluid communication with the end portion 60 of the second duct assembly 36, the crossover duct 38 and the end portion 44 of the first duct assembly 34. Operation of fan assembly 48 in an exhaust mode pulls dust entrained air from opening 60 through duct assembly 36 and crossover duct 38 into duct assembly 34 and from opening 44 into duct assembly 34. The treated air is then exhausted through the single duct outlet 46.

Spray scrubbers 50 and 68 are positioned adjacent to openings 46 and 62 within the duct assemblies 34 and 36. Demisters 52 and 70 are positioned between the fan assemblies 48 and 64 and the scrubbers 50 and 68 respectively and remove the water and dust from the air in the duct assemblies 34 and 36.

Thus, as illustrated in FIGS. 3 and 4, dust entrained air is drawn into the inlets 44 and 60 of the duct assemblies 34 and 36 and selectively dispersed to either side 18 or 20 of the mining machine for exhausting from either duct outlets 46 or 62. This is accomplished by selected opening and closing of the air control gates 84 and 86 in ducts 34 and 36, respectively, and the gates 80 and 82 in the crossover duct 38.

Figure 6:
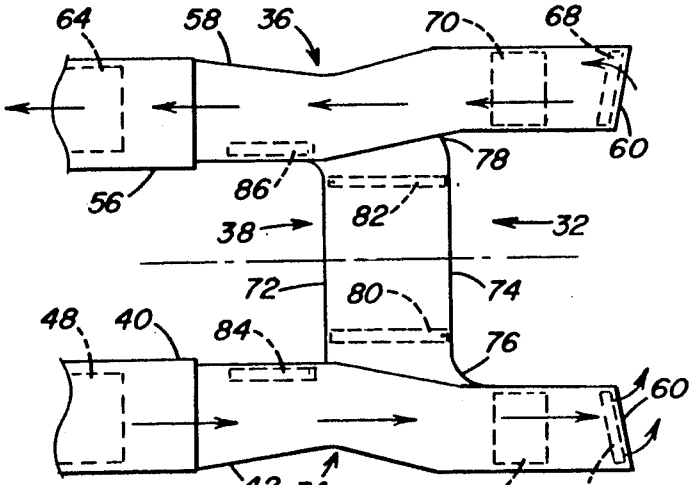
FIG. 6 is a schematic diagram of the duct system similar to FIG. 5, illustrating an alternate path for the simultaneous flow of pollutant laden air and fresh air through the ducts.

In accordance with the present invention the fan assemblies 48 and 64 are selectively operated in one mode as exhaust fans. The fan assemblies 48 and 64 may be operated simultaneously or one idle while the other is operated to direct the treated air from either side of the mining machine as shown in FIGS. 3 and 4. Further in accordance with the present invention, operation of the fan assemblies 48 and 64 can be reversed as shown in FIGS. 5 and 6 to supply fresh air to the mine face while dust entrained air is removed from the mine face.

Figure 5:
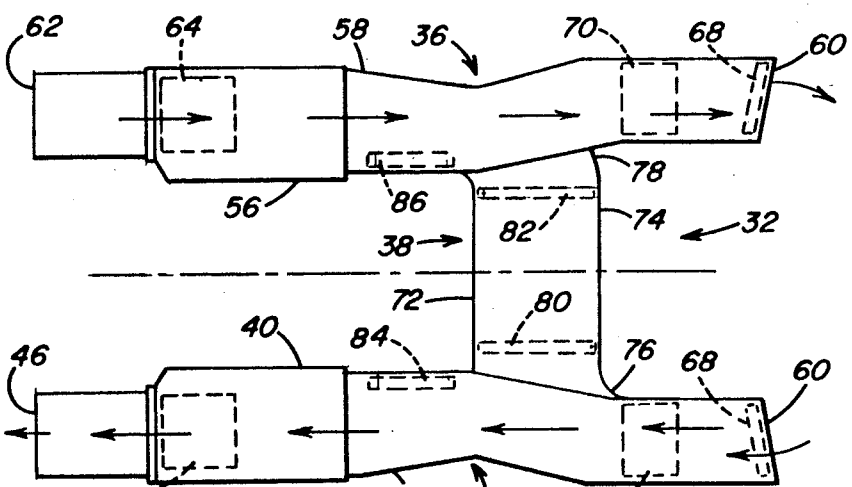
FIG. 5 is a schematic diagram of the dust collecting system, illustrating the crossover duct closed from the longitudinal ducts for directing the flow of pollutant laden air from the mine face through one duct while fresh air is supplied through the other duct to the mine face.

Referring to FIG. 5 there is illustrated operation of the fan assembly 48 in duct assembly 34 to pull dust entrained air into inlet 44 and through scrubber 50 and demister 52 for dust removal. With the crossover duct gates 80 and 82 closed the treated air is exhausted from the duct outlet 46. Simultaneously with the dust collecting operation, air substantially free of pollutants is supplied to the mine face through duct assembly 36. This is accomplished by operating fan assembly 64 in a mode where fresh air is drawn into duct 36 through the opening 62 and conveyed through duct 36 to opening 60 where the air is directed toward the mine face to ventilate the mine face. The primary objective is to dilute the concentration of any methane gas present at the mine face.

The operations of exhausting dust entrained air from the mine face and ventilating the mine face occur simultaneously in accordance with the present invention. The direction of air flow to and from the mine face is selective as determined by the direction of operation of the reversible fan assemblies 48 and 64. One flow pattern, as described above, is illustrated in FIG. 5. The simultaneous flow pattern is reversed as shown in FIG. 6. The operation of fan assembly 48 is reversed to ventilate the mine face; while, the operation of fan assembly 64 is reversed to exhaust dust entrained air from the mine face. In both modes of operation of simultaneous ventilation and exhausting, the crossover duct 38 is removed from service by the closing of gates 80 and 82.

By selective operation of the direction of rotation of the fan assemblies 48 and 64 combined with selected opening and closing of gates 80, 82, 84 and 86, a versatile system of collecting dust and ventilating a mine face is provided on the mining machine 10. The respective operations can be shifted from side to side on the mining machine. The fan assemblies 48 and 64 can be operated to exhaust the mine face, as well as ventilate the mine face, from either side of the mining machine as needed by the mining operation.

When the material dislodging operation of the continuous miner is stopped it is desirable to continue operation of the dust collecting system of the present invention, as a significant amount of respirable dust remains suspended in the working environment of the underground mine. In one embodiment a control device, such as a time delay circuit, is employed to maintain operation of the fans 48 and 64 to continue the dust collecting operation for several minutes after the mining operation ceases.

As an added safety feature and to minimize exposure of the fans to overload, a conventional electrical or mechanical sensor (not shown) is provided at the gate corresponding to the respective fan. When the gate is closed, the sensor automatically interrupts the operation of the particular fan, since the operation of the fan in a blind ended dust will serve no useful purpose. Mine personnel may incorrectly assume that the motor is off, however, and be injured as a result.

While the gates 80, 82, 84 and 86 are described herein as the pivotally hinged type, various other methods of sliding dampers, with or without position controllers, are examples of variations suitable for use in practicing the present invention.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A mining machine comprising, a mobile frame having a front end portion and a rear end portion, a boom member pivotally secured to said mobile frame front end portion and extending forwardly therefrom, dislodging means connected to the front end of the boom member for dislodging mine material from a mine face, conveyor means extending rearwardly on said mobile frame for transporting mined material dislodged from the mine face from said dislodging means to said frame rear end portion, collecting means positioned on said mobile frame for removing pollutants entrained in the air surrounding said dislodging means, said collecting means including a first duct system and a second duct system extending longitudinally on said mobile frame on opposite sides of said conveyor means, respectively, said first and second duct systems each including an inlet positioned rearwardly of said dislodging means and an outlet positioned adjacent to said frame rear end portion with a continuous passageway extending between said inlet and said outlet for the flow of air therethrough, a fan positioned in said passageway of each of said first and second duct systems adjacent to said outlet, each of said fans being reversible to direct pollutant entrained air in a first direction from said inlet to said outlet and to direct air in a second direction substantially free of pollutants from said outlet to said inlet, and control means for selectively operating each of said fans to direct pollutant entrained air in a selected one of said duct systems in said first direction while directing air substantially free of pollutants in the other of said duct systems in said second direction.

2. A mining machine as set forth in claim 1 which includes, a crossover duct interconnecting said first and second duct systems, and said crossover duct extending transversely on said mobile frame and having opposite end portions communicating with said passageways of said first and second duct systems for the flow of air therethrough.

3. A mining machine as set forth in claim 2 in which, said crossover duct opposite end portions are connected to said passageways between said inlet and said fan of each passageway.

4. A mining machine as set forth in claim 2 which includes, air flow control means for closing said crossover duct from flow of air therethrough to said first and second duct systems.

5. A mining machine as set forth in claim 4 which includes, means for selectively opening and closing said air flow control means.

6. A mining machine as set forth in claim 4 in which, said air flow control means includes a gate pivotally mounted in said crossover duct adjacent said opposite end portions thereof, and said gate movable between an open position permitting flow of air between said respective duct system and said crossover duct and a closed position preventing flow of air between said respective duct system and said crossover duct.

7. A mining machine as set forth in claim 1 in which, said control means are operable in one mode to rotate said fan in said first duct systems to pull pollutant entrained air through said passageway thereof from the mine face and rotate said fan in said second duct systems to diffuse air substantially free of pollutants through said passageway to the mine face, and said control means being operable in a second mode to reverse the direction of rotation of said fans to in turn reverse the direction of flow of air through said first and second duct systems.

8. A mining machine as set forth in claim 1 which includes, a crossover duct interconnecting said first and second duct systems, said crossover duct extending transversely on said mobile frame and having opposite end portions communicating with said passageways of said first and second duct systems for the flow of air therethrough, a pair of gates pivotally positioned in said crossover duct for opening and closing said crossover duct to control the flow of air between said first and second duct systems through said crossover duct, and a gate pivotally positioned in said first and second duct systems between said fan and the point of connection of said crossover duct to said respective duct system.

9. A mining machine as set forth in claim 8 which includes, means for pivoting said gates in said crossover duct and said first and second duct systems between open and closed positions to selectively direct the flow of air between said first and second duct systems through said crossover duct.

10. A mining machine as set forth in claim 1 which includes, scrubber and demister system positioned in each of said first and second duct systems adjacent to said outlet thereof.

11. A method for ventilating the face of an underground mine comprising the steps of:

positioning a mining machine adjacent to a mine face, positioning a pair of passageways of ductwork on the mining machine to extend longitudinally on opposite sides of the mining machine, conveying air through the pair of passageways of the ductwork between an inlet at one end of each passageway adjacent to the mine face and an outlet an opposite end of each passageway removed from the mine face, selectively directing the flow of air through each passageway of the pair of passageways in a preselected direction between said inlet and said outlet to exhaust pollutant laden air from the mine face in a first mode and supply fresh air to the mine face in a second mode, and conveying pollutant laden air in the first mode away from the mine face through a selected one of the passageways from the inlet to the outlet thereof while simultaneously conveying air substantially free of pollutants in the second mode through the other of the passageways from the outlet to the inlet thereof toward the mine face.

12. A method as set forth in claim 11 which includes, connecting the pair of passageways with a crossover duct, and directing the flow of air from one passageway to the other passageway through the crossover duct to and from the mine face.

13. A method as set forth in claim 12 which includes, interrupting the flow of air through the crossover duct, and pulling pollutant laden air from the mine face through one passageway on a selected side of the mining machine while simultaneously diffusing air substantially free of pollutants to the mine face through the other passageway on the opposite side of the mining machine.

14. A method as set forth in claim 12 which includes, pulling pollutant laden air into the inlets of each of the passageways, diverting the flow of air from one passageway through the crossover duct into the other passageway, and directing the flow of air from both passageways through the outlet of one passageway while preventing the flow of air through the outlet of the other passageway.

15. A method as set forth in claim 14 which includes, changing the direction of the flow of air through the outlet of one passageway by directing the flow of air through the outlet of the other passageway so that the air entering the inlets of the passageways exits from the outlet of the passageway on a selected side of the mining machine.

16. A method as set forth in claim 15 which includes, substantially removing the pollutants entrained in the air entering the inlets of the passageways at a point in each passageway adjacent to the outlet of the passageway.

17. A ventilation system for a mining machine comprising, a pair of air passage ducts extending longitudinally in substantially spaced apart relation on a mining machine, said ducts each having an inlet for receiving pollutant laden air into said respective duct and an outlet for discharging air from said duct, air flow control means positioned in each of said ducts adjacent to said outlet for drawing flow of air in a first mode from said inlet to said outlet and in a second mode from said outlet to said inlet, and adjustment means for actuating said air flow control means to direct flow of air through said ducts in a selected one of said first and second modes to simultaneously direct air from said outlet to said inlet in one of said ducts while directing air from said inlet to said outlet in the other of said ducts.

18. A ventilation system as set forth in claim 17 which includes, a crossover duct extending between said pair of air passage ducts between said inlets thereof and said air flow control means, and barrier means positioned in said crossover duct for opening and closing said crossover duct for the flow of air between said air passage ducts through said crossover duct.

19. A ventilation system as set forth in claim 18 which includes, barrier means positioned in each of said air passage ducts between the connection of said crossover duct to said air passage duct and said air flow control means to open and close said air passage ducts to the flow of air between said crossover duct and said outlets of said ducts.

20. A ventilation system as set forth in claim 19 which includes, means positioned in each of said air passage ducts between said outlets thereof and the connection of said ducts to said crossover duct for substantially removing the pollutants from the air drawn into said ducts, and means for controlling said barrier means in said crossover duct and said air passage ducts for directing the flow of air drawn into said inlets of said ducts to a selected one of said outlets of said ducts while blocking said outlet of the opposite duct from the flow of air therethrough.

* * * * *